US008805229B2

(12) United States Patent
Negishi

(10) Patent No.: US 8,805,229 B2
(45) Date of Patent: Aug. 12, 2014

(54) PRINTING APPARATUS ALLOWING SETTING RANGE OF SHEET CHARACTERISTIC VALUES AND METHOD FOR CONTROLLING THE SAME

(75) Inventor: Akira Negishi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 331 days.

(21) Appl. No.: 12/335,374

(22) Filed: Dec. 15, 2008

(65) Prior Publication Data

US 2009/0160117 A1 Jun. 25, 2009

(30) Foreign Application Priority Data

Dec. 20, 2007 (JP) ..... 2007-328733

(51) Int. Cl.
*G03G 15/00* (2006.01)

(52) U.S. Cl.
USPC ..... 399/75; 399/389; 399/391

(58) Field of Classification Search
USPC ..... 399/75, 389, 391
See application file for complete search history.

(56) References Cited

U.S. PATENT DOCUMENTS

| | | | | |
|---|---|---|---|---|
| 3,589,808 | A * | 6/1971 | Del Vecchio | 399/405 |
| 5,229,814 | A * | 7/1993 | Hube et al. | 399/14 |
| 6,768,883 | B2 * | 7/2004 | Wiegand et al. | 399/82 |
| 7,061,648 | B2 | 6/2006 | Nakajima | |
| 2002/0113984 | A1 | 8/2002 | Nakajima | |
| 2003/0133146 | A1 * | 7/2003 | Parry | 358/1.15 |
| 2004/0179052 | A1 * | 9/2004 | Phillips et al. | 347/14 |
| 2006/0045547 | A1 * | 3/2006 | Aiyama | 399/16 |
| 2006/0099019 | A1 * | 5/2006 | Howe | 399/395 |
| 2006/0115306 | A1 * | 6/2006 | Lofthus et al. | 399/341 |
| 2007/0031162 | A1 * | 2/2007 | Dombrowski | 399/81 |
| 2007/0177164 | A1 * | 8/2007 | Ahmad | 358/1.1 |
| 2007/0182996 | A1 | 8/2007 | Nakajima | |
| 2009/0135442 | A1 * | 5/2009 | Taylor et al. | 358/1.13 |

FOREIGN PATENT DOCUMENTS

| | | | |
|---|---|---|---|
| JP | 62-230539 | A | 10/1987 |
| JP | 07-010344 | A | 1/1995 |
| JP | 10-190936 | A | 7/1998 |
| JP | 2000-307845 | A | 11/2000 |
| JP | 2002-019236 | A | 1/2002 |
| JP | 2002-218243 | | 8/2002 |
| JP | 2004-284323 | A | 10/2004 |
| JP | 2005-024881 | A | 1/2005 |
| JP | 2005-262640 | A | 9/2005 |
| JP | 2006-035809 | A | 2/2006 |
| JP | 2006-315241 | A | 11/2006 |
| JP | 2008-186255 | A | 8/2008 |

OTHER PUBLICATIONS

Machine translation of JP 2006-035089 to Ogawa.*

* cited by examiner

*Primary Examiner* — David Bolduc
(74) *Attorney, Agent, or Firm* — Canon USA Inc IP Division

(57) ABSTRACT

Printing processing is performed on a sheet having a characteristic value within a range of a characteristic value of a sheet which is defined usable in the printing processing in accordance with a specific print job. Specifically, in a case where a test page print job is input, a CPU selects a sheet feeding tray on which sheets having a characteristic value within a range of a characteristic value represented by characteristic value range information. The CPU performs a control operation so that a sheet is fed from the selected sheet feeding tray to a printer unit and the printer unit executes the test page print job.

10 Claims, 18 Drawing Sheets

FIG. 9

| ID | PAPER NAME | TYPE | GRAMMAGE | SURFACE NATURE | FIXING TEMPERATURE | PRINTING SPEED | TRANSFER VOLTAGE |
|---|---|---|---|---|---|---|---|
| 0001-0000 | THIN PAPER | 1 | 70 g/m$^2$ | HIGH QUALITY | 177°C | 240 mm/sec | 0.9 KV |
| 0002-0000 | PLAIN PAPER | 1 | 90 g/m$^2$ | HIGH QUALITY | 180°C | 240 mm/sec | 1.0 KV |
| 0003-0000 | HEAVY PAPER | 1 | 150 g/m$^2$ | HIGH QUALITY | 182°C | 200 mm/sec | 1.1 KV |
| 0004-0000 | RECYCLED PAPER | 1 | 90 g/m$^2$ | RECYCLED | 180°C | 240 mm/sec | 1.0 KV |
| 0005-0000 | COATED PAPER 1 | 1 | 120 g/m$^2$ | COATED | 182°C | 200 mm/sec | 1.1 KV |
| 0006-0000 | COATED PAPER 2 | 1 | 180 g/m$^2$ | COATED | 184°C | 180 mm/sec | 1.2 KV |
| 0007-0000 | TAB PAPER 1 | 1 | 120 g/m$^2$ | HIGH QUALITY | 182°C | 200 mm/sec | 1.1 KV |
| 0008-0000 | TAB PAPER 2 | 1 | 180 g/m$^2$ | HIGH QUALITY | 184°C | 180 mm/sec | 1.2 KV |

FIG. 10

| ID | PAPER NAME | TYPE | GRAMMAGE | SURFACE NATURE | FIXING TEMPERATURE | PRINTING SPEED | TRANSFER VOLTAGE |
|---|---|---|---|---|---|---|---|
| 0101-0000 | AAA COMPANY PLAIN PAPER | 3 | 90 g/m$^2$ | HIGH QUALITY | 180°C | 240 mm/sec | 1.0 KV |
| ⋮ | ⋮ | ⋮ | ⋮ | ⋮ | ⋮ | ⋮ | ⋮ |
| 0234-0000 | ABC PAPER COATED HIGH GRADE 100gsm | 3 | 100 g/m$^2$ | COATED | 187°C | 240 mm/sec | 1.0 KV |
| 0235-0000 | ABC PAPER COATED HIGH GRADE 150gsm | 3 | 150 g/m$^2$ | COATED | 189°C | 240 mm/sec | 1.0 KV |
| 0236-0000 | ABC PAPER COATED HIGH GRADE 200gsm | 3 | 200 g/m$^2$ | COATED | 191°C | 200 mm/sec | 1.2 KV |
| 0237-0000 | ABC PAPER COATED HIGH GRADE 250gsm | 3 | 250 g/m$^2$ | COATED | 192°C | 240 mm/sec | 1.2 KV |
| 0238-0000 | ABC PAPER LABEL 170gsm | 3 | 170 g/m$^2$ | COATED | 190°C | 200 mm/sec | 1.1 KV |
| 0239-0000 | DEF COMPANY RECYCLED PAPER 80gsm | 3 | 80 g/m$^2$ | RECYCLED | 180°C | 180 mm/sec | 1.1 KV |
| 0240-0000 | DEF COMPANY RECYCLED PAPER 100gsm | 3 | 100 g/m$^2$ | RECYCLED | 180°C | 200 mm/sec | 1.1 KV |
| 0241-0000 | DEF COMPANY RECYCLED PAPER 120gsm | 3 | 120 g/m$^2$ | RECYCLED | 180°C | 180 mm/sec | 1.2 KV |
| ⋮ | ⋮ | ⋮ | ⋮ | ⋮ | ⋮ | ⋮ | ⋮ |
| 1100-0000 | ZZZ COMPANY PLAIN PAPER | 3 | 93 g/m$^2$ | HIGH QUALITY | 180°C | 240 mm/sec | 1.0 KV |

FIG. 11

| ID | PAPER NAME | TYPE | GRAMMAGE | SURFACE NATURE | FIXING TEMPERATURE | PRINTING SPEED | TRANSFER VOLTAGE |
|---|---|---|---|---|---|---|---|
| 0002-0001 | CUSTOM PLAIN PAPER 1 | 2 | 95 g/m$^2$ | HIGH QUALITY | 179°C | 240 mm/sec | 1.0 KV |
| 0002-0002 | CUSTOM PLAIN PAPER 2 | 2 | 93 g/m$^2$ | HIGH QUALITY | 180°C | 240 mm/sec | 1.0 KV |
| 0236-0001 | ABC COATED 1 | 2 | 200 g/m$^2$ | COATED | 191°C | 200 mm/sec | 1.2 KV |
| 0236-0002 | ABC COATED 2 | 2 | 210 g/m$^2$ | COATED | 180°C | 200 mm/sec | 1.2 KV |
| 0237-0001 | ABC COATED 3 | 2 | 250 g/m$^2$ | COATED | 192°C | 240 mm/sec | 1.3 KV |

| SHEET FEEDING TRAY | PAPER ID |
|---|---|
| CASSETTE 311 | 0001-0000 |
| CASSETTE 312 | 0002-0000 |
| CASSETTE 313 | 0002-0001 |
| CASSETTE 314 | 0236-0002 |
| MANUAL FEEDING TRAY 315 | 0002-0002 |

FIG. 16

PRINTER TEST PAGE

PRINTER PRODUCT NAME :
Color Printer X

PRINTER NAME : Printer-003

SYSTEM VERSION : 101

DATE : 6/28/2007

FIG. 18

| JOB TYPE | SHEET CHARACTERISTIC | | | DISCHARGE DESTINATION TRAY |
|---|---|---|---|---|
| | GRAMMAGE ($g/m^2$) | SURFACE NATURE | SHAPE | |
| TEST PAGE PRINTING JOB | 64 TO 209 | HIGH QUALITY | NORMAL | SHEET DISCHARGING TRAY 106 |
| CALIBRATION MEASUREMENT PAGE PRINTING JOB | 80 TO 105 | HIGH QUALITY | NORMAL | SHEET DISCHARGING TRAY 107 |

FIG. 19

| SHEET FEEDING TRAY | PAPER ID | PAPER NAME | TYPE | GRAMMAGE | SURFACE NATURE | FIXING TEMPERATURE | PRINTING SPEED | TRANSFER VOLTAGE |
|---|---|---|---|---|---|---|---|---|
| CASSETTE 311 | 0001-0000 | THIN PAPER | 1 | 70 g/m$^2$ | HIGH QUALITY | 177°C | 240 mm/sec | 0.9 KV |
| CASSETTE 312 | 0002-0000 | PLAIN PAPER | 1 | 90 g/m$^2$ | HIGH QUALITY | 180°C | 240 mm/sec | 1.0 KV |
| CASSETTE 313 | 0002-0001 | CUSTOM PLAIN PAPER 1 | 2 | 95 g/m$^2$ | HIGH QUALITY | 179°C | 240 mm/sec | 1.0 KV |
| CASSETTE 314 | 0236-0002 | ABC COATED 2 | 2 | 210 g/m$^2$ | COATED | 180°C | 200 mm/sec | 1.2 KV |
| MANUAL FEEDING TRAY 315 | 0002-0002 | CUSTOM PLAIN PAPER 2 | 2 | 93 g/m$^2$ | HIGH QUALITY | 180°C | 240 mm/sec | 1.0 KV |

FIG. 20

SUPPLY SHEET FOR PRINTING "TEST PAGE".

<SHEET CHARACTERISTIC INFORMATION>
GRAMMAGE = 64 TO 209 g/m$^2$
SURFACE NATURE = HIGH-QUALITY PAPER
SHAPE = NORMAL

OK

FIG. 21

IS THE FOLLOWING SHEET USED FOR PRINTING PROCESSING?

SHEET FEEDING TRAY = CASSETTE 314
GRAMMAGE = 210 g/m$^2$
SURFACE NATURE = COATED
SHAPE = NORMAL

CANCEL OK 2002 2001

PRINTING APPARATUS ALLOWING SETTING RANGE OF SHEET CHARACTERISTIC VALUES AND METHOD FOR CONTROLLING THE SAME

BACKGROUND OF THE INVENTION

1. Field of the Invention

The present invention relates to a printing apparatus and a method for controlling the printing apparatus.

2. Description of the Related Art

In general, printing apparatuses prints test pages for checking whether printing processing is properly performed on sheets. Furthermore, in color printing processing, calibration measurement pages used to examine color reproducibility of printing apparatuses are printed (for example, Japanese Patent Laid-Open No. 2002-218243). In such a printing apparatus, a sheet in which a calibration measurement page is printed is measured using a measurement apparatus, and in accordance with a result of the measurement, the printing apparatus is controlled so that desired color reproducibility is attained.

However, when a test page and a calibration measurement page are to be printed, sheets which have appropriate characteristics should be used for individual these pages. For example, when the calibration measurement page is to be printed, a plain paper is suitably used, and a sheet having a large weight per unit area, such as heavy paper, is not suitable for the printing of the calibration measurement page. This is because when the calibration measurement page is printed on heavy paper, the printing apparatus is adjusted so that color reproducibility suitable for printing processing using heavy paper is attained. Due to this adjustment, when plain paper which is frequently used for the printing processing is used, undesired color reproducibility may be obtained.

To address this problem, before the test page or the calibration measurement page are printed, it is determined that only a predetermined plurality of types of paper are allowed to be used, and accordingly, types of paper which are not suitable for printing of the test page or the calibration measurement page cannot be used. However, if it is determined that only a predetermined plurality of types of paper are allowed to be used but the plurality of types of paper are not provided in the printing apparatus, the test page or the calibration measurement page cannot be printed.

SUMMARY OF THE INVENTION

The present invention provides an improved printing apparatus which addresses the above problem.

Furthermore, the present invention provides a printing apparatus and a method for controlling the printing apparatus which performs printing processing using a sheet having a characteristic value corresponding to a characteristic value of a sheet usable in the printing processing in accordance with a specific print job.

According to an aspect of the present invention, there is provided a printing apparatus including an input unit configured to input a print job, a plurality of sheet stacking units configured to hold sheets stacked thereon, a printing unit configured to perform printing processing on a sheet fed from at least one of the plurality of sheet stacking units in accordance with the print job, a first storage unit configured to store first characteristic value information representing characteristic values of the sheets stacked on the plurality of sheet stacking units, a second storage unit configured to store second characteristic value information representing a characteristic value of sheets usable in the printing processing performed in accordance with a specific print job, a selection unit configured to select, when the specific print job is input by the input unit, one of the plurality of sheet stacking units on which sheets having the characteristic value represented by the second characteristic value information stored in the second storage unit are stacked in accordance with the first characteristic value information and the second characteristic value information, and a controller configured to control the printing unit so that a sheet is fed from the sheet stacking unit selected by the selection unit and the printing unit executes the specific print job.

According to another aspect of the present invention, there is provided a control method for controlling a printing apparatus which includes a plurality of sheet stacking units configured to hold sheets stacked thereon, a first storage unit configured to store first characteristic value information representing characteristic values of the sheets stacked on the plurality of sheet stacking units, and a second storage unit configured to store second characteristic value information representing a characteristic value of sheets usable in the printing processing performed in accordance with a specific print job. The control method includes inputting a print job, performing printing processing on a sheet fed from at least one of the plurality of sheet stacking units in accordance with the print job, selecting, when the specific print job is input, one of the plurality of sheet stacking units on which sheets having the characteristic value represented by the second characteristic value information stored in the second storage unit are stacked in accordance with the first characteristic value information and the second characteristic value information, and controlling the printing processing so that a sheet is fed from the selected sheet stacking unit and the specific print job is executed.

As many apparently widely different exemplary embodiments of the present invention can be made without departing from the spirit and scope thereof, it is to be understood that the invention is not limited to the specific exemplary embodiments thereof except as defined in the appended claims.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate numerous exemplary embodiments, features and aspects of the invention and, together with the description, serve to explain the principles of the invention.

FIG. 9 is a diagram illustrating sheet information Type 1.

FIG. 10 is a diagram illustrating sheet information Type 3.

FIG. 11 is a diagram illustrating sheet information Type 2.

FIG. 16 is a diagram illustrating an example of an image printed in accordance with image data representing a test page.

FIG. 18 is a table listing characteristic value range information of print jobs including the specific page.

FIG. 19 is a diagram illustrating the sheet feeding tray information.

FIG. 20 is a diagram illustrating a still further example of the operation screen displayed in the operation unit.

FIG. 21 is a diagram illustrating a still further example of the operation screen displayed in the operation unit.

DESCRIPTION OF THE EXEMPLARY EMBODIMENTS

Figure 1:
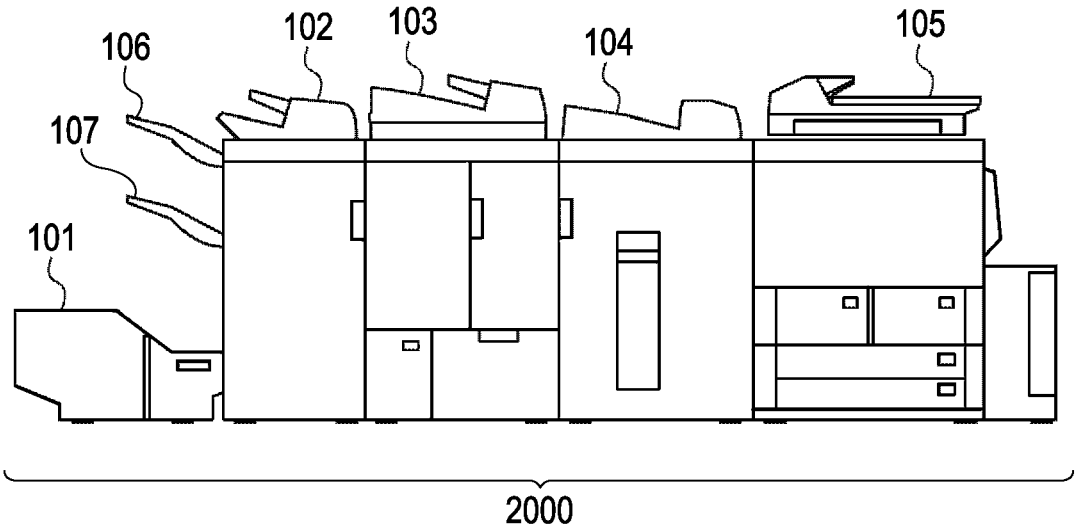
FIG. 1 is a diagram illustrating an example of an entire configuration of a binding system.

The present invention will now be described in detail with reference to the drawings showing various exemplary embodiments thereof. In the drawings, elements and parts which are identical throughout the views are designated by identical reference numerals, and duplicate description thereof is omitted.

Entire Configuration of Binding System

FIG. 1 is a diagram illustrating an example of an entire configuration of a binding system 2000 according to a first exemplary embodiment of the present invention.

In FIG. 1, a printing apparatus 105 performs printing processing on sheets in accordance with image data and conveys the sheets which have been subjected to the printing processing to a stacker 104. The stacker 104 stacks the sheets conveyed from the printing apparatus 105 on a stacking tray (not shown). The stacker 104 may convey the sheets supplied from the printing apparatus 105 to a case binding apparatus 103 without stacking the sheets on the stacking tray thereof. The case binding apparatus 103 holds a plurality of sheets S supplied from the printing apparatus 105 through the stacker 104 so that the plurality of sheets S are stacked on a stacking tray of the case binding apparatus 103 as a sheet bundle. Then, the case binding apparatus 103 generates a case binding book by covering the sheet bundle stacked on the stacking tray by a covering sheet provided in a covering sheet holding tray.

The case binding apparatus 103 may convey the plurality of sheets S supplied from the stacker 104 to a saddle stitching binding apparatus 102 without stacking the plurality of sheets S on the stacking tray thereof. The saddle stitching binding apparatus 102 generates a saddle stitching binding book by performing stapling processing on a sheet bundle S1 including the plurality of sheets S supplied from the printing apparatus 105 through the case binding apparatus 103. The saddle stitching binding book generated using the saddle stitching binding apparatus 102 is conveyed to a paper cutter 101 where the saddle stitching binding book is cut. The saddle stitching binding apparatus 102 includes sheet discharging trays 106 and 107 which serve as units for holding discharged sheets (paper) conveyed from the printing apparatus 105.

Configuration for Controlling Printing Apparatus

Figure 2:
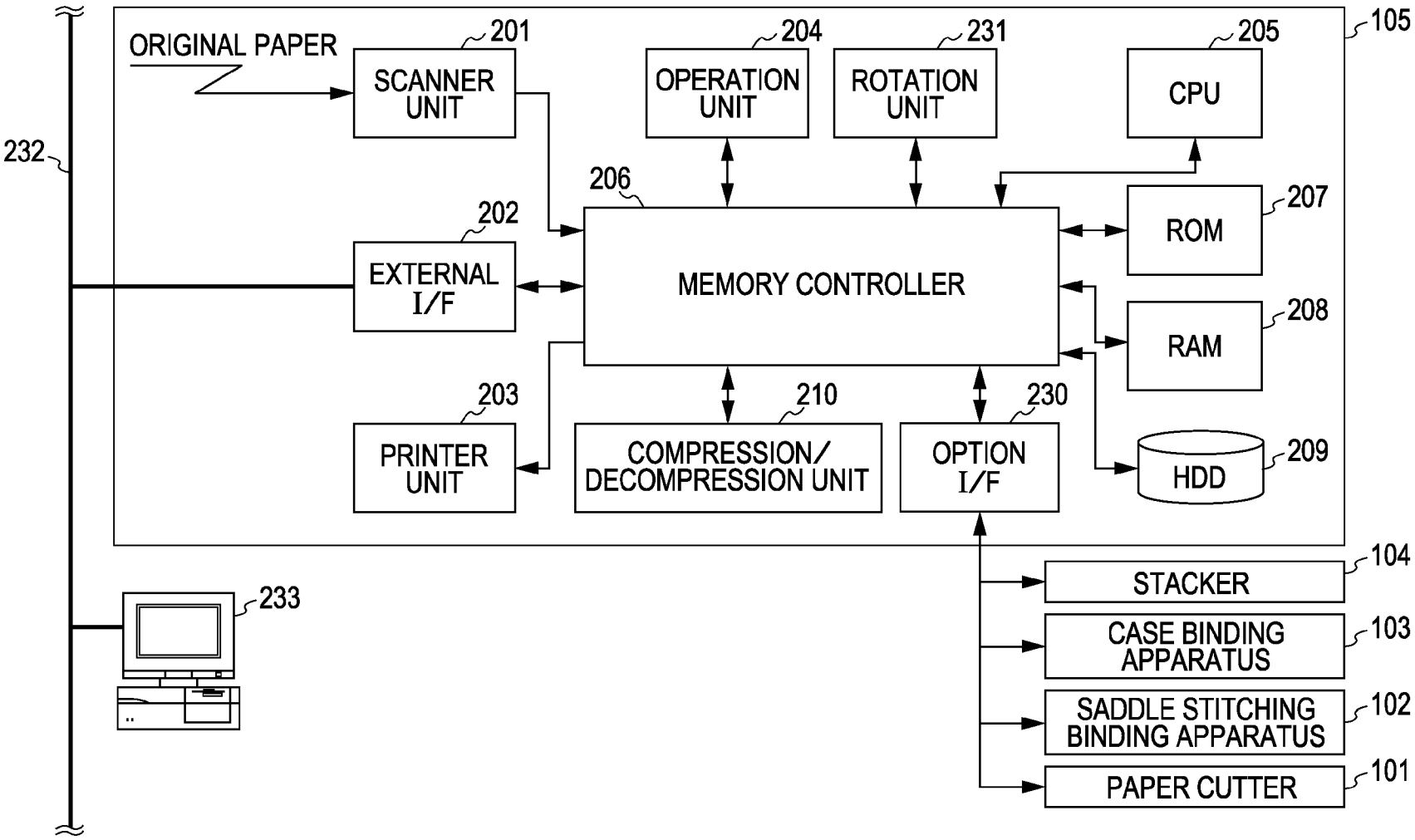
FIG. 2 is a diagram illustrating an example of a configuration for controlling processing of a printing apparatus.

FIG. 2 is a diagram illustrating an example of a configuration for controlling processing of the printing apparatus 105 according to the first exemplary embodiment of the present invention.

In FIG. 2, a scanner unit 201 optically reads a plurality of original sheets (which are sheets (paper) in which images have been printed thereon) so as to generate image data, and performs image processing (such as shading correction processing) on the read image data. Furthermore, the scanner unit 201 stores the image data which represents images included in a plurality of pages and which has been subjected to the image processing as a single print job in a hard disk (HDD) 209. An external I/F 202 receives a print job including image data representing images of a plurality of pages from a computer terminal 233 serving as an external apparatus connected to the printing apparatus 105 through a network 232. The print job received using the external I/F 202 is stored in the hard disk 209. A printer unit 203 performs printing processing on a plurality of sheets (paper) in accordance with the print job stored in the hard disk 209. Note that since the print job includes the image data representing the images in the plurality of pages, the image data is divided into a plurality of image data blocks, and the plurality of image data blocks are individually printed on a plurality of sheets. An operation unit 204 accepts various instructions input by a user using the printing apparatus 105, and supplies the received instructions to a memory controller 206 where various settings are performed on the printing apparatus 105.

A CPU (Central Processing Unit) 205 writes a program read from a ROM (Read-Only Memory) 207 into a RAM (Random Access Memory) 208, and controls the entire binding system 2000 including the printing apparatus 105 by executing the program stored in the RAM 208. Note that the ROM 207 stores a program which is used to interpret PDL (Page Description Language) code data received as a print job from the external apparatus through the external I/F 202. Furthermore, the ROM 207 stores a program used to generate data which can be printed using the printer unit 203 after the PDL code data is interpreted. The memory controller 206 controls accesses from various units to the ROM 207, the RAM 208, and the hard disk 209.

A compression/decompression unit 210 performs compression processing on image data stored in the RAM 208 or the hard disk 209 by means of various compression methods such as a JBIG (Joint Bi-level Image Experts Group) method and a JPEG (Joint Photographic Experts Group) method. Furthermore, the compression/decompression unit 210 performs decompression processing of decompressing image data which has been compressed by means of one of the various compression methods through the compression processing.

When the image data stored in the hard disk 209 is transmitted to the printer unit 203 and the printing processing is to be performed, a rotation unit 231 performs rotation processing if it is necessary to rotate the image data. Examples of the rotation processing performed using the rotation unit 231 include 180-degrees rotation processing of rotating the image data upside down, and rotation processing of rotating the image data by arbitrary degrees such as 90-degrees rotation processing. Note that the CPU 205 sets a rotation angle of the rotation processing performed using the rotation unit 231.

An option I/F 230 is used when the CPU 205 communicates with the stacker 104, the case binding apparatus 103, the saddle stitching binding apparatus 102, and the paper cutter 101, which are option apparatuses connected to the printing apparatus 105. The stacker 104, the case binding apparatus 103, the saddle stitching binding apparatus 102, and the paper cutter 101 independently have own CPUs (not shown) which control operations of the corresponding apparatuses. The CPU 205 of the printing apparatus 105 transmits control commands used to control the CPUs of the option apparatuses through the option I/F 230 so as to control the stacker 104, the case binding apparatus 103, the saddle stitching binding apparatus 102, and the paper cutter 101.

Configuration of Printing Apparatus

Figure 3:
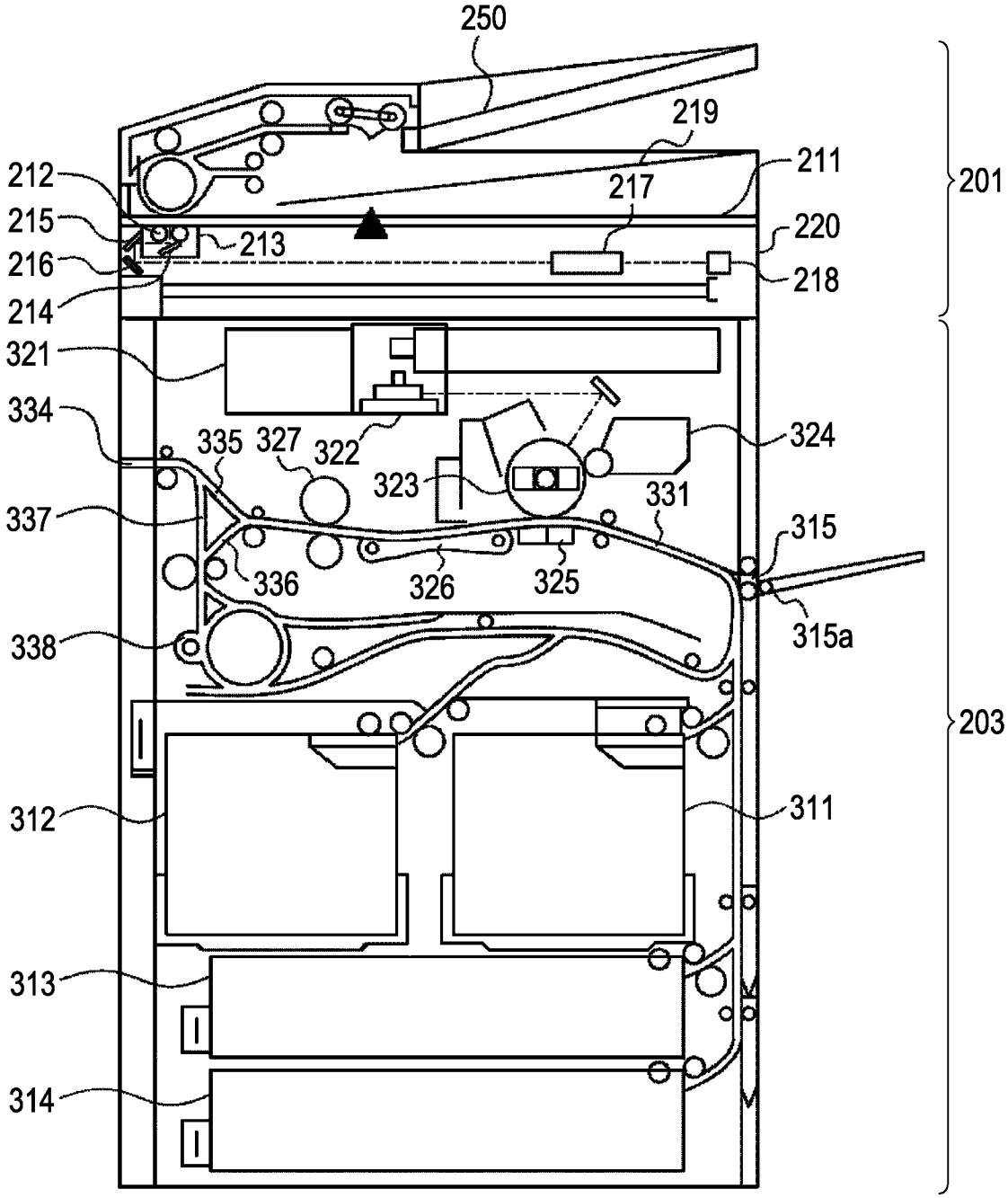
FIG. 3 is a diagram illustrating a hardware configuration of the printing apparatus.

Referring to FIG. 3, a configuration of the printing apparatus 105 will now be described.

The printing apparatus 105 is mainly constituted by the scanner unit 201 and the printer unit 203. In the scanner unit 201, a plurality of sheets, that is, a sheet bundle, stacked on a original feeding unit 250 are supplied to a platen glass 211 one by one from a first page (uppermost page) of the stacked sheet bundle. Then, after a reading operation performed using a scanner 220 is finished, the original feeding unit 250 discharges results of the reading operation to the discharge tray 219. When an original sheet is conveyed to the platen glass 211, the scanner 220 lights a lamp 212, causes an optical unit 213 to start moving, and scans the sheet while irradiating the original sheet from below. Light reflected by the original sheet is introduced through a plurality of mirrors 214, 215, and 216, and a lens 217 to a CCD image sensor (hereinafter referred to as a CCD sensor) 218 where an image of the scanned original sheet is read as image data. The image data read using the CCD sensor 218 is subjected to certain image processing, and then, is stored in the hard disk 209.

In the printer unit 203, a laser beam corresponding to image data read from the hard disk 209 is output from a laser emitting unit 322 driven by a laser driver 321. In accordance with the laser beam, an electrostatic latent image is formed on a photoreceptor drum 323 on which the laser beam is irradiated, and a developing unit 324 attaches a developer (tonner, for example) to a portion of the electrostatic latent image.

On the other hand, at a time when the irradiation of the laser beam is started, a sheet S is supplied from one of cassettes 311 to 314 and a manual feeding tray 315 through a conveying path 331 to a transfer unit 325. Note that the cassettes 311 to 314 and the manual feeding tray 315 serve as sheet stacking units which hold a plurality of stacked sheets. Here, the manual feeding tray 315 includes a sheet sensor 315*a* which detects stacking of the sheet S. The transfer unit 325 transfers the developer which has been attached to the photoreceptor drum 323 onto the sheet S. The sheet S on which the developer has been transferred is conveyed to a fixing unit 327 using a conveying belt 326, and heated using the fixing unit 327. In this way, the developer on the sheet S is fixed on the sheet S. After the developer is fixed on the sheet S, the sheet S is conveyed through conveying paths 335 and 334 to the stacker 104. In a case where the sheet S is to be reversely conveyed to the stacker 104, the CPU 205 controls the printer unit 203 so that the sheet S is supplied to conveying paths 336 and 338. Thereafter, the sheet S is reversely conveyed through a conveying path 337 and the conveying path 334 to the stacker 104.

Figure 6:
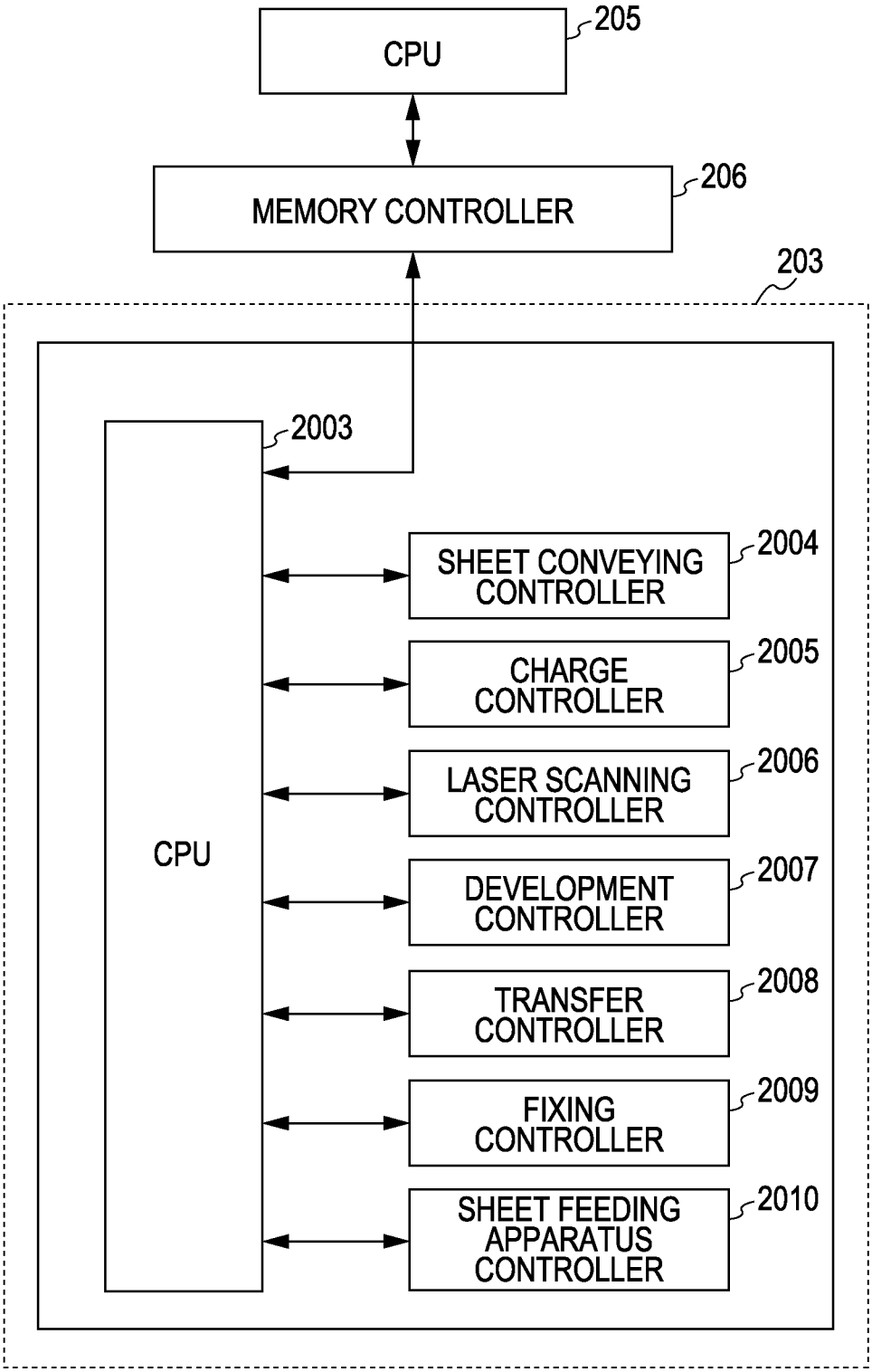
FIG. 6 is a diagram illustrating an example of a configuration for control processing of a printer unit.

A configuration for control processing of the printer unit 203 according to the first exemplary embodiment will now be described with reference to FIG. 6.

The printer unit 203 included in the printing apparatus 105 is capable of communicating with the CPU 205 through the memory controller 206. A CPU 2003 of the printer unit 203 receives image data and a command for executing printing processing from the memory controller 206, analyzes the received image data, converts the image data into bit data, and analyzes the received command.

The printer unit 203 includes various controllers controlled by the CPU 2003. Examples of the various controllers include a sheet conveying controller 2004 which controls various rollers which are used to convey the sheet S and which are included in the printing apparatus 105, and a charge controller 2005 which controls voltage to be applied to a charging roller for charging the photoreceptor drum 323 to a predetermined potential. The printer unit 203 further includes a laser scanning controller 2006 which controls laser-beam scanning for exposing a surface of the photoreceptor drum 323 in accordance with image data received using the CPU 2003 from the memory controller 206. The printer unit 203 further includes a development controller 2007 which controls the developing unit 324 so that an electrostatic latent image formed on the surface of the photoreceptor drum 323 is developed. The printer unit 203 also includes a transfer controller 2008 which controls a transfer voltage to be applied to the transfer unit 325 so that a tonner image formed on the photoreceptor drum 323 is transferred on the sheet S. The printer unit 203 further includes a fixing controller 2009 which controls rotation of a pair of rollers included in the fixing unit 327 and which controls a power supplied to a heater included in at least one of the pair of rollers so that the transferred tonner image is fixed on the sheet S. The printer unit 203 still further includes a sheet feeding apparatus controller 2010 which controls driving of rollers included in the cassettes 311 to 314 so that the sheet S is supplied to the stacker 104.

Configuration of Operation Unit

A configuration of the operation unit 204 included in the printing apparatus 105 will now be described with reference to FIG. 4.

The operation unit 204 has a hard key group 4-240 including various hard keys 4-241 to 4-246. The operation unit 204 further includes a liquid crystal display unit 4-250, such as a liquid crystal display device, configured by a dot matrix. The liquid crystal display unit 4-250 includes a touch panel on a surface thereof. When a user using the printing apparatus 105 presses a key display section, the operation unit 204 detects a key input and transmits a signal corresponding to the key input to the CPU 205. The CPU 205 controls the printing apparatus 105 in accordance with a program stored in the ROM 207 so as to execute an operation in accordance with the received signal.

A power supply key 4-243 is used to turn the power on or off. A power saving key 4-244 is used to set a power saving mode or cancel the power saving mode. A start key 4-241 allows the user to input an instruction indicating start of various operations, such as an instruction indicating start of an operation of reading an image in an original using the scanner unit 201. A stop key 4-242 allows the user to input an instruction indicating stop of an operation being performed in the binding system 2000 including the printing apparatus 105.

A key group 4-245 includes numeric keys including 0 to 9 used to input the number of copies and a zoom magnification and a clear key which is used to cancel the input. The number of copies input using the key group 4-245 is displayed in a liquid crystal display section 4-253. A reset key 4-246 is used to reset conditions set by the user using the liquid crystal display unit 4-250 and the hard key group 4-240.

The liquid crystal display unit 4-250 displays an operation state of the binding system 2000 in accordance with an instruction of the CPU 205. The liquid crystal display unit 4-250 also displays a touch key. In the liquid crystal display unit 4-250, a selection key 4-252 is used to select one of the cassettes on which a plurality of sheets S (paper) used for printing processing is stacked. When the user presses the selection key 4-252, the CPU 205 controls the operation unit 204 so that a sheet selection screen is displayed on the liquid crystal display unit 4-250 as shown in FIG. 5A.

Figure 4:
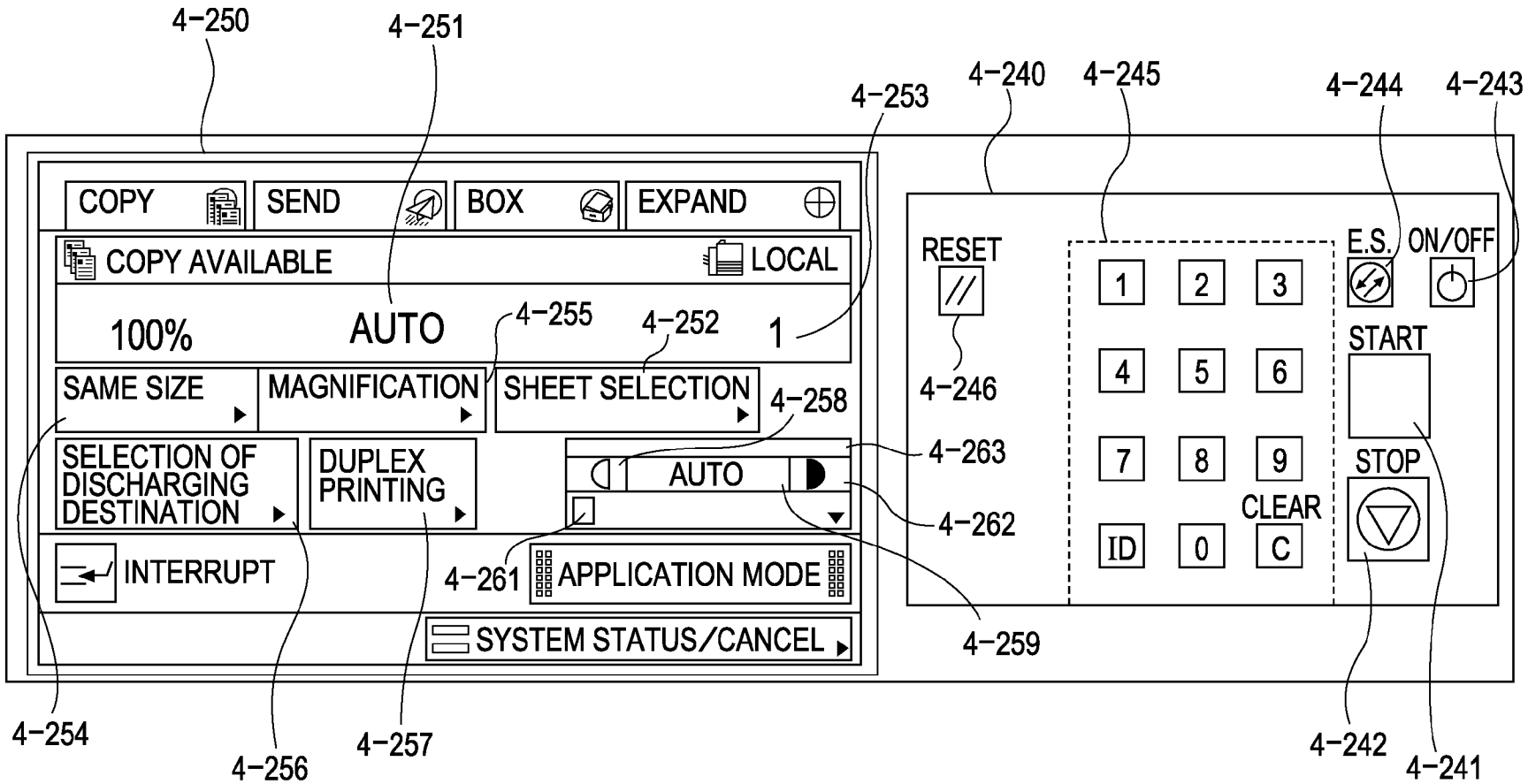
FIG. 4 is a diagram illustrating a configuration of an operation unit.
Figure 5A:
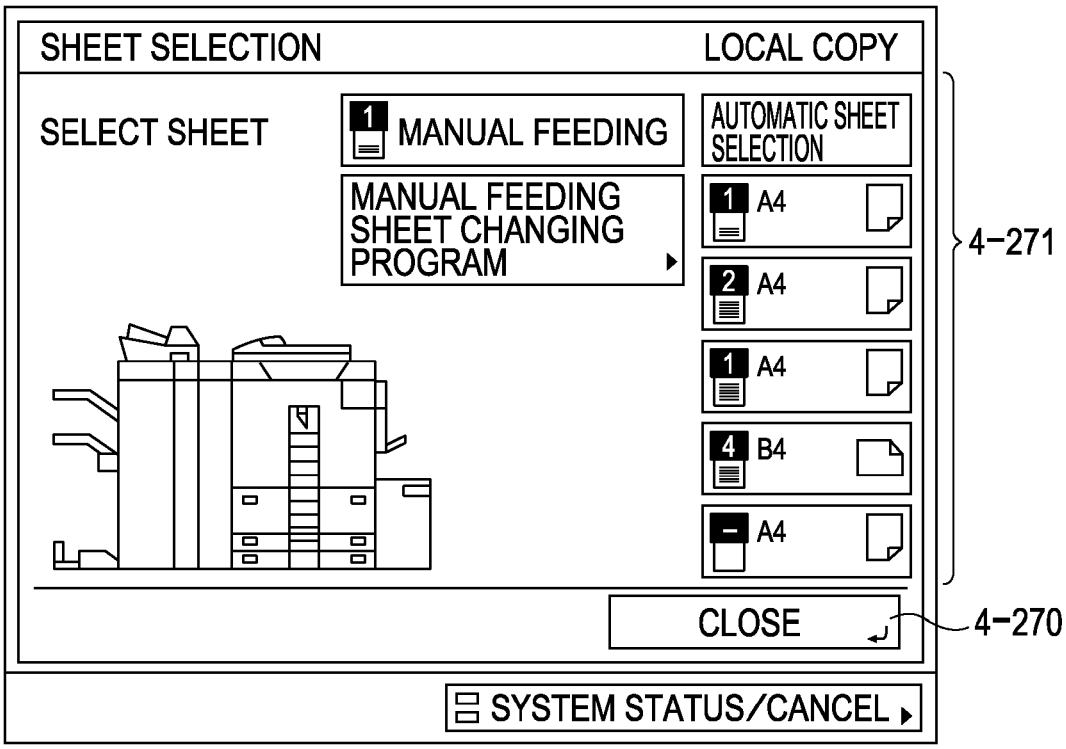
FIGS. 5A to 5C are diagrams illustrating examples of an operation screen displayed in the operation unit.

A key group 4-271 shown in FIG. 5A is used to select one of the cassettes 311 to 315 which is to be used to the printing processing. When the user presses a close key 4-270, the CPU 205 performs a control operation of closing the screen of FIG. 5A so that the screen shown in FIG. 4 is displayed again, and displays the selected cassette in a display section 4-251.

In FIG. 4, keys 4-258 and 4-262 are used to control color density. The CPU 205 displays a level of the color density controlled using the keys 4-258 and 4-262 in a display section 4-263. A key 4-259 is used to turn on or off a function of automatically controlling the color density. A key 4-261 is used to set a photographing mode or a text mode.

Figure 5B:
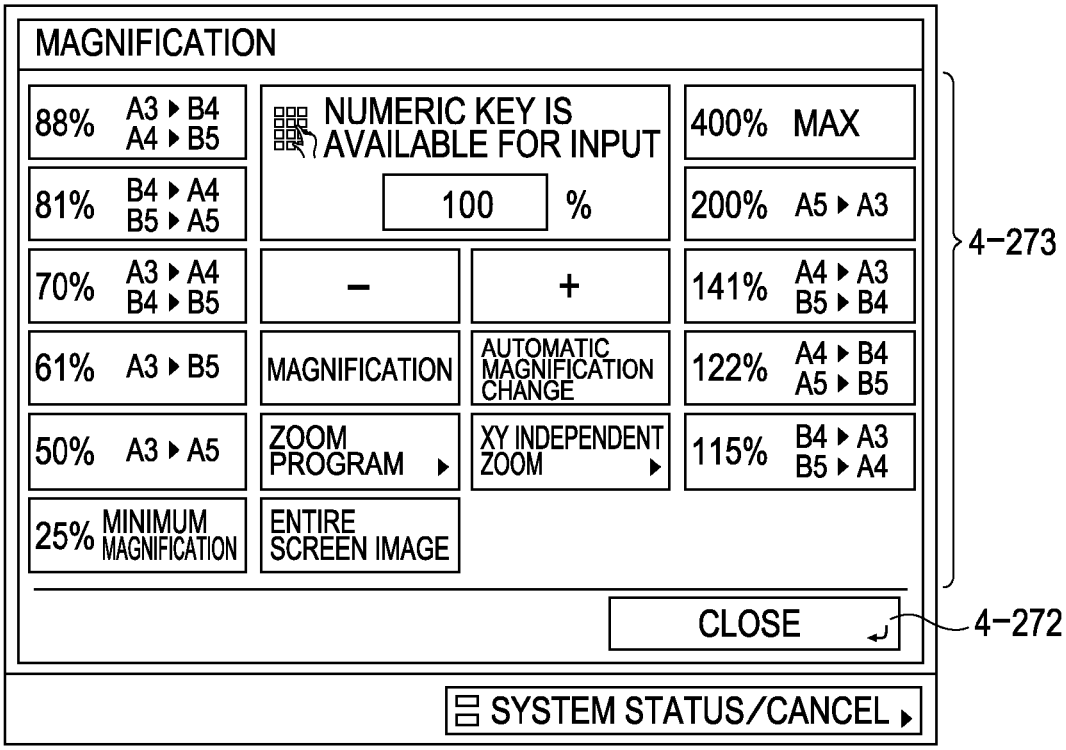

A key 4-254 and a key 4-255 are used to perform same-magnification setting and magnification-changing setting, respectively. When the key 4-255 is pressed, the CPU 205 instructs the liquid crystal display unit 4-250 to display a magnification screen as shown in FIG. 5B so that a precise change of a magnification is allowed to be performed. After the user determines a magnification using the key group 4-273 and presses a close key 4-272, the CPU 205 closes this screen and returns to the screen shown in FIG. 4. Then, the determined magnification is displayed in the display section 4-251 under the control of the CPU 205.

Figure 5C:
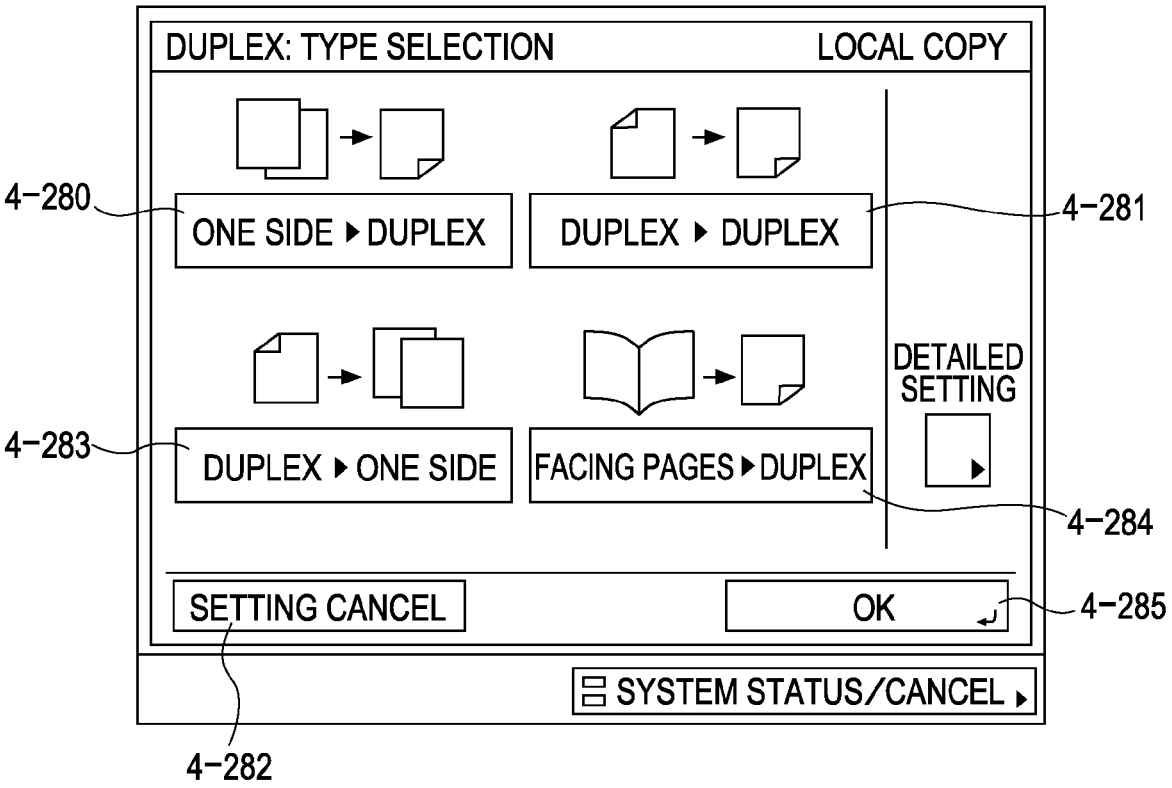

When a duplex key 4-257 is pressed, the CPU 205 instructs the liquid crystal display unit 4-250 to display a duplex printing setting screen as shown in FIG. 5C. Setting of duplex printing will be described hereinafter with reference to FIG. 5C.

In FIG. 5C, a first setting key 4-280 is used to print originals (hereinafter referred to as a "one-side printing sheets"), each of which includes an image on only one side thereof, on both sides of a sheet. A second setting key 4-281 is used to print an original (hereinafter referred to as a "duplex printing sheet"), in which images are printed on both sides thereof, on both sides of a sheet. A third setting key 4-283 is used to print a duplex printing original as one-side printing sheets. A fourth setting key 4-284 is used to print two facing pages as a duplex printing sheet.

An OK key 4-285 is used to enable setting set by the user using the duplex printing setting screen shown in FIG. 5C. When the OK key 4-285 is pressed, the CPU 205 enables the setting set using the duplex printing setting screen shown in FIG. 5C, and instructs the liquid crystal display unit 4-250 to display the screen shown in FIG. 4 again. A cancel key 4-282 is used to cancel the setting set using the duplex printing setting screen shown in FIG. 5C. When the cancel key 4-282 is pressed, the CPU 205 cancels the setting set using the duplex printing setting screen shown in FIG. 5C, and instructs the liquid crystal display unit 4-250 to display the screen shown in FIG. 4 again.

A discharging destination selection key 4-256 shown in FIG. 4 is used to allow the user to select one of units included in the binding system 2000 as a destination for discharge of a sheet subjected to the printing processing performed using the printing apparatus 105.

Figure 7:
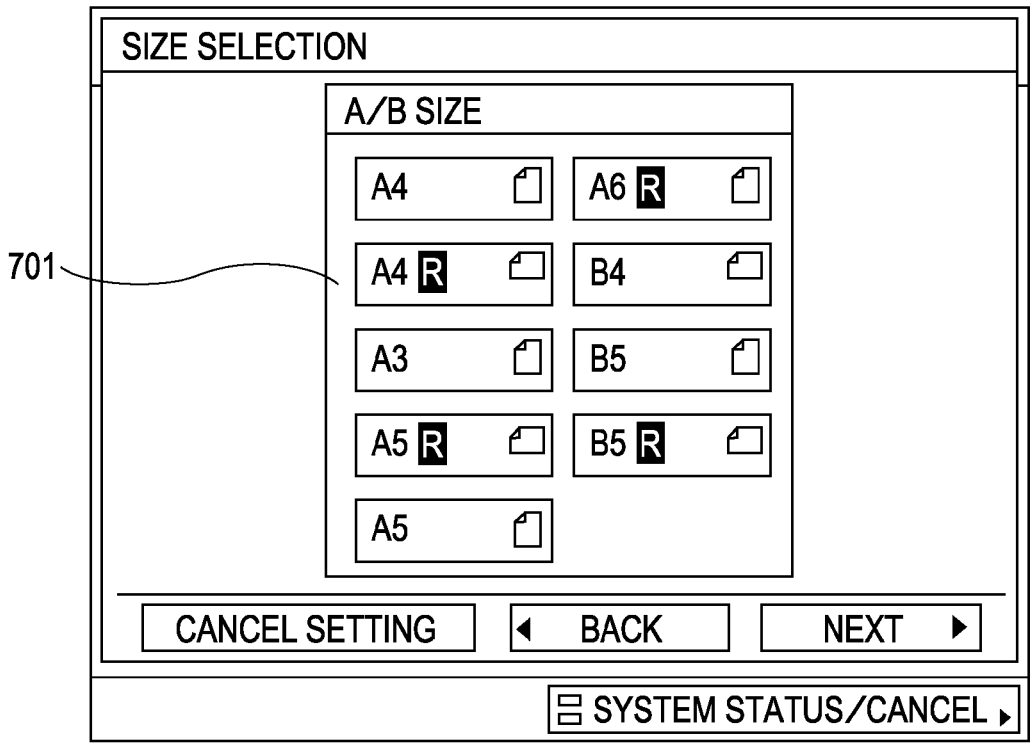
FIG. 7 is a diagram illustrating another example of the operation screen displayed in the operation unit.

FIG. 7 shows an operation screen used to select a size of sheets S to be stacked on one of the sheet feeding cassettes (the cassettes 311 to 314 and the manual feeding tray 315). The operation screen shown in FIG. 7 is displayed after one of the sheet feeding cassettes (the cassettes 311 to 314 and the manual feeding tray 315) is selected. A key group 701 included in the operation screen of FIG. 7 is used to allow the user to select a size of the sheets S to be stacked on one of the cassettes selected using the screen of FIG. 5A. For example, when the user presses a size "A4" in the screen of FIG. 7 and then presses a "next" key, the CPU 205 instructs the liquid crystal display unit 4-250 to display an operation screen shown in FIG. 8.

Figure 8:
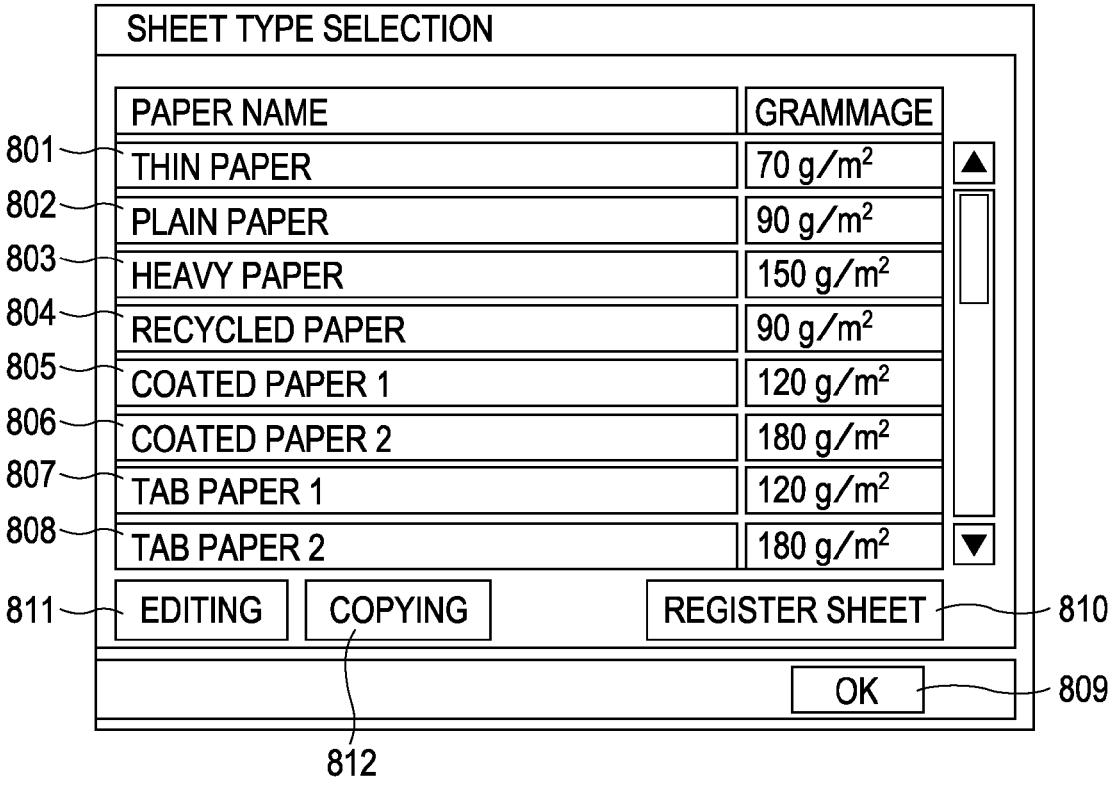
FIG. 8 is a diagram illustrating still another example of the operation screen displayed in the operation unit.

FIG. 8 is a diagram illustrating a display screen of the operation unit 204 used to set a type of sheet stacked on one of the sheet feeding cassettes.

In FIG. 8, a type of sheet is selected by pressing one of keys 801 to 808. Thereafter, when the user using the printing apparatus 105 selects an OK key 809, the type of sheet is determined, and the operation screen of FIG. 5A is displayed again.

Figures 14, 15:
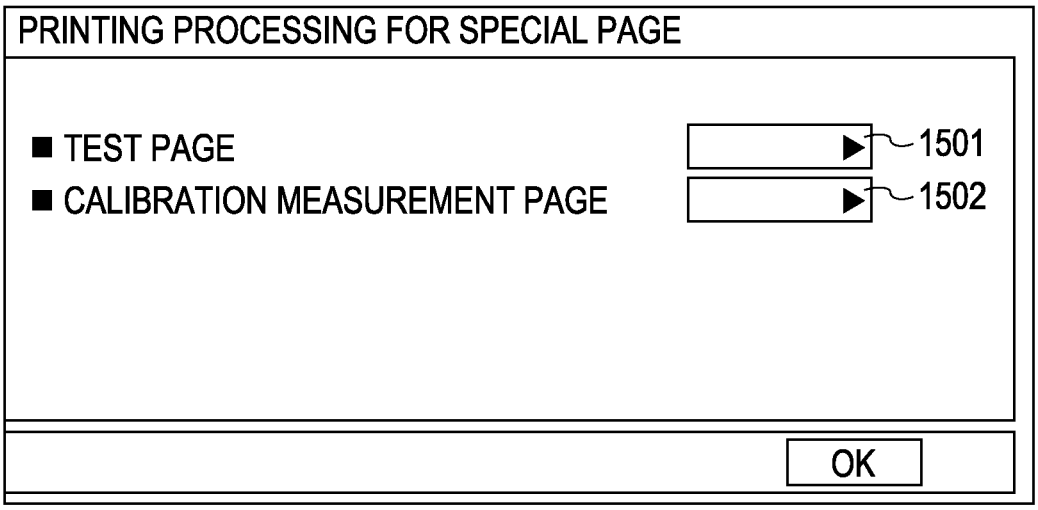
FIG. 14 is a diagram illustrating sheet feeding tray information.
FIG. 15 is a diagram illustrating a screen used to instruct an execution of printing of a specific page.

As described above, a size of the sheets to be stacked on one of the cassettes selected in the screen of FIG. 5A is determined in the display screen of FIG. 7, and a type of sheet is determined in the display screen of FIG. 8. Then, the CPU 205 associates a sheet ID assigned to the sheets having the set size and the set type with the selected sheet feeding tray, and the sheet ID is stored in the hard disk 209 as sheet feeding tray information. FIG. 14 shows an example of the sheet feeding tray information. For example, in a case where printing processing is to be executed after a print job is received from the computer terminal 233, the print job generated using the computer terminal 233 may only specify one of the sheet feeding trays (sheet feeding source). In this case, since the print job includes information which specifies one of the sheet feeding trays, the CPU 205 can specify a type of sheet used in the printing processing with reference to the sheet feeding tray information of FIG. 14.

Next, sheet information stored in the hard disk 209 will be described.

In the printing apparatus 105, the printer unit 203 performs the printing processing using a variety of control information. Here, the "control information" corresponds to information used to control the various units included in the printer unit 203, such as a temperature value used when the fixing unit 327 is heated, a value of a transfer voltage applied using the transfer unit 325, and a sheet convey speed value (printing speed value) used when a sheet is conveyed using the printer unit 203. Although it can be expected that the printing apparatus 105 performs the printing processing using various types of sheet, constant results are preferably obtained irrespective of the types of sheet. Therefore, when the control information is added to the sheet information, the printing apparatus 105 can control the transfer voltage, the printing speed, and the fixing temperature in accordance with the types of sheet.

According to this exemplary embodiment, three types of sheet information, that is, sheet information Type 1, sheet information Type 2, and sheet information Type 3 are employed.

First, the sheet information Type 1 will be described.

The sheet information Type 1 is stored in a table as shown in FIG. 9 in the hard disk 209 of the printing apparatus 105 in advance (for example, at a time of manufacturing). In the table shown in FIG. 9, "ID" denotes information which discriminates a plurality of sheets having the sheet information Type 1 from one another. The CPU 205 of the printing apparatus 105 discriminates types of sheet by "ID". In FIG. 9, "Paper Name" denotes a name assigned to a sheet, "Grammage" denotes a weight per 1 $m^2$ of a sheet, and "Surface Nature" denotes texture of a surface of a sheet. Note that since each of "Grammage" and "Surface Nature" is information representing a characteristic of the sheet, each of "Grammage" and "Surface Nature" is referred to as "sheet characteristic information" hereinafter.

Furthermore, "Fixing Temperature" denotes a temperature value obtained when the fixing unit 327 is heated, "Printing Speed" denotes a value of a conveying speed obtained when a sheet is conveyed for printing processing in the printer unit 203, and "Transfer Voltage" denotes a value of a transfer voltage to be applied to a sheet using the transfer unit 325. Sheets having the sheet information Type 1 are selected using the operation unit 204 of the printing apparatus 105 for the printing processing. Specifically, the sheets including the sheet information Type 1 are selected using the operation screen shown in FIG. 8. In the example of FIG. 9, eight types of sheet having the sheet information Type 1 are registered in the hard disk 209 of the printing apparatus 105. However, the sheets which have the sheet information Type 1 and which are to be registered in advance are not limited eight types of sheet, but the arbitrary number of types of sheet may be registered in advance.

Next, the sheet information Type 3 will be described.

The sheet information Type 3 is stored in the hard disk 209 included in the printing apparatus 105 (for example, at a time of manufacturing) similarly to the sheet information Type 1. However, the sheet information Type 3 is different from the sheet information Type 1 in that sheets having the sheet information Type 3 cannot be selected using the screen shown in FIG. 8 as sheets to be used in the printing processing performed by the printing apparatus 105. That is, the sheets having the sheet information Type 3 cannot be used in the printing processing performed by the printing apparatus 105, but can be used in the printing processing performed by the printing apparatus 105 only after the sheets are re-registered as sheets having sheet information Type 2, which will be described hereinafter. Although there are thousands of types of sheet available in markets, it is difficult to allow all types of sheet to be used in the printing processing performed by the printing apparatus 105. Specifically, it is difficult to select a desired type of sheet from among thousands of types of sheet using the operation screen shown in FIG. 8. Therefore, the printing apparatus 105 allows the user using the printing apparatus 105 to select only a desired type of sheet from among the sheets having the sheet information Type 3 for the printing processing.

Specifically, the sheets having the sheet information Type 3 are to be used in the printing processing performed by the printing apparatus 105, the user using the printing apparatus 105 presses a registration key 810 in the operation screen of FIG. 8 for registration of the sheets. In accordance with the press of the registration key 810, the CPU 205 instructs the operation unit 204 to display an operation screen shown in FIG. 12. In the operation screen of FIG. 12, the sheets having the sheet information Type 3 can be selected. In an example shown in FIG. 12, among sheets types having the sheet information Type 3, eight types of sheet having IDs of 0234-0000 to 0241-0000 are displayed to be selected. After one of keys 1201 to 1208 which discriminates the eight types of sheet from each other is pressed and then an OK key 1209 is pressed, the sheets having the sheet information Type 3 are registered as sheets having the sheet information Type 2 which can be selected using the operation screen of FIG. 8. By performing such a registration, another type of sheet which can be used in the printing processing performed by the printing apparatus 105 is newly registered (added). Note that although it is assumed that the eight types of sheet having the sheet information Type 3 can be selected in the example of FIG. 12, 1000 types of sheet having the sheet information Type 3 are included in a table shown in FIG. 10. Therefore, in the screen shown in FIG. 12, any one of the 1000 types of sheet can be selected while sheet information is displayed by scrolling the screen.

The sheet information Type 2 will now be described.

Figure 12:
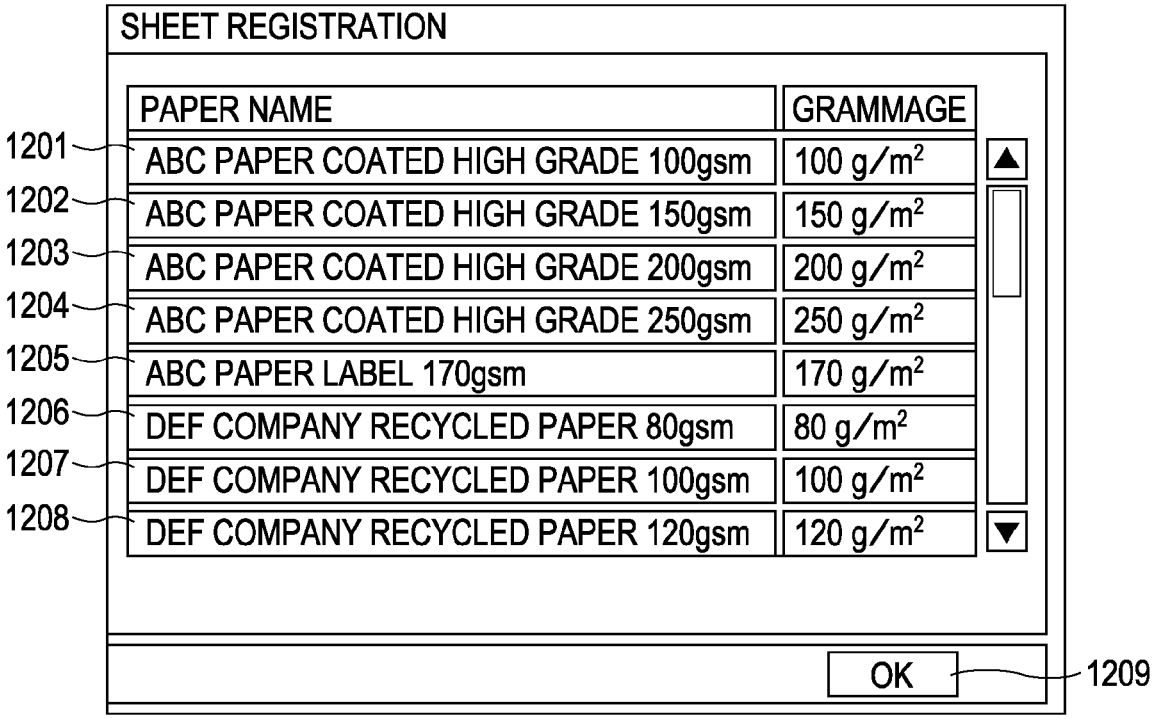
FIG. 12 is a diagram illustrating a further example of the operation screen displayed in the operation unit.
Figure 13:
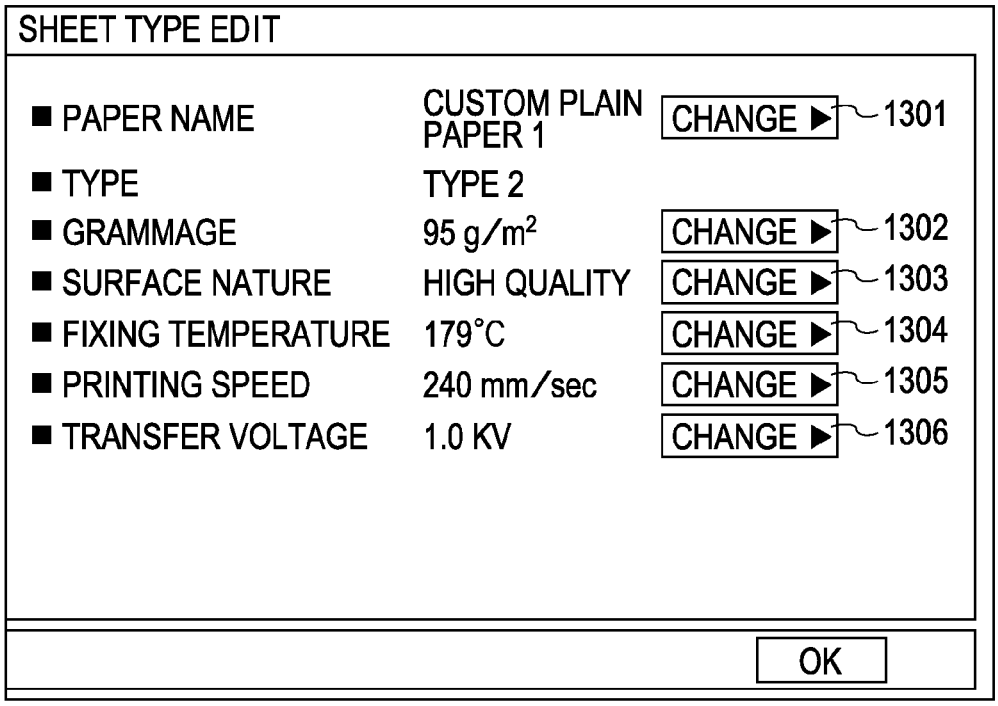
FIG. 13 is a diagram illustrating a still further example of the operation screen displayed in the operation unit.

Sheets having the sheet information Type 2 are obtained by re-registering sheets having the sheet information Type 3 as sheets having the sheet information Type 2 using the screen shown in FIG. 12. In addition, the sheets having the sheet information Type 2 may be obtained by copying the sheets having the sheet information Type 1 and registering the copied sheets as the sheets having the sheet information Type 2. When the sheets having the sheet information Type 1 are to be copied, a copy key 812 is pressed while the sheets having the sheet information Type 1 are selected in the operation screen of FIG. 8. When the copy key 812 is pressed, the sheets having the sheet information Type 2 are newly added separately from the sheets having the sheet information Type 1. FIG. 11 shows examples of the sheets having the sheet information Type 2. Note that although the sheets having the sheet information Type 2 obtained by copying the sheets having the sheet information Type 1 have sheet information the same as that of the sheets having the sheet information Type 1, names different from the names of the sheets having the sheet information Type 1 are assigned. Note that the sheets having the sheet information Type 2 can be edited by pressing an editing key 811 in the screen of FIG. 8. For example, a case where, among the sheets having the sheet information Type 1 shown in FIG. 9, a sheet having an ID of 0002-0000 is to be newly registered (copied) as a sheet having the sheet information Type 2 will be described. In this case, a sheet having the sheet information Type 2 is newly registered (copied) by pressing the copy key 812 while the key 802 is selected. Thereafter, when the sheet registered as the sheet having the sheet information Type 2 is selected in the screen of FIG. 8, and the editing key 811 is pressed, an operation screen shown in FIG. 13 is displayed in the operation unit 204. Here, when the user using the printing apparatus 105 can change "Paper Name" information included in the sheet information by pressing a change key 1301 and inputting characters using the operation unit 204 in a screen (not shown) displayed after pressing the change key 1301. In addition, the user using the printing apparatus 105 can change "Grammage" information included in the sheet information by pressing a change key 1302 and inputting a numeric value using the operation unit 204 in a screen (not shown) displayed after pressing the change key 1302. Furthermore, the user using the printing apparatus 105 can change "Surface Nature" information included in the sheet information by pressing a change key 1303 and performing selection processing (processing of selecting one of "high quality", "reproduction", and "coating") using the operation unit 204 in a screen (not shown) displayed after pressing the change key 1303. Moreover, the user using the printing apparatus 105 can change "Fixing Temperature" information included in the sheet information by pressing a change key 1304 and inputting a numeric value using the operation unit 204 in a screen (not shown) displayed after pressing the change key 1304. Similarly, the user using the printing apparatus 105 can change "Printing Speed" information included in the sheet information by pressing a change key 1305 and inputting a numeric value using the operation unit 204 in a screen (not shown) displayed after pressing the change key 1305. In addition, the user using the printing apparatus 105 can change "Transfer Voltage" information included in the sheet information by pressing a change key 1306 and inputting a numeric value using the operation unit 204 in a screen (not shown) displayed after pressing the change key 1306.

Note that the changing processing described above are performed using the CPU 205 by rewriting the sheet information Type 2 stored in the hard disk 209 in accordance with the information input using the operation unit 204. As a result of the changing processing, the operation unit 204 displays sheets having the sheet information Type 1 and sheets having the sheet information Type 2 which can be used in the printing processing performed by the printing apparatus 105.

Instruction of Execution of Print job for Printing Special Page

FIG. 15 is a diagram illustrating a screen used to instruct an execution of printing of a special page.

The screen of FIG. 15 is displayed in the operation unit 204 of the printing apparatus 105.

When the user using the printing apparatus 105 is desired to print a special page, the screen of FIG. 15 is displayed in the operation unit 204. Here, the "special page" is image data stored in the hard disk 209 of the printing apparatus 105 in advance (for example, at a time of manufacturing). The image data corresponding to the special page is different from the image data included in the print job received from the computer terminal 233.

In an example of FIG. 15, a test page and a calibration measurement page are shown as special pages. The test page corresponding to image data is subjected to printing processing so that checking is performed as to whether the printing processing is properly performed when the printing apparatus 105 is installed. When the user using the printing apparatus 105 presses a button 1501 shown in FIG. 15, the image data corresponding to the test page is read from the hard disk 209 and is printed using the printer unit 203. FIG. 16 shows an example of an image printed in accordance with the image data corresponding to the test page. On the other hand, the calibration measurement page corresponding to image data is subjected to printing processing so that color reproducibility of the printing apparatus 105 is checked. Although the description is made assuming that the printing apparatus 105 performs black-and-white printing processing in FIG. 3, it is assumed that color printing processing can be performed hereinafter. In the printing apparatus 105 which performs the color printing processing, there is a problem in that color reproducibility of an image printed on a sheet is changed in accordance with a change of an environment (for example, temperature and humidity) where the printing apparatus 105 is installed. To address this problem, the fixing unit 327 should perform fixing processing in a temperature suitable for the environment where the printing apparatus 105 is installed, and a transfer voltage used to transfer a tonner image onto a sheet using the transfer unit 325 should be made suitable for the environment. Accordingly, in the printing apparatus 105, the calibration measurement page is printed on a sheet using the printer unit 203, and the sheet is read as image data using the scanner unit 201. The image data read using the scanner unit 201 is analyzed by the CPU 205. In accordance with the analysis, the CPU 205 instructs the printer unit 203 to make color reproducibility (image quality) of an image to be printed on a sheet suitable for the environment. Thereafter, when the user using the printing apparatus 105 presses a button 1502 included in the screen of FIG. 15, the image data corresponding to the calibration measurement page is read from the hard disk 209, and the printer unit 203 performs printing processing.

Processing of Printing Special Page

Processing of printing a special page will be described taking processing of printing a test page as an example.

Figure 17:
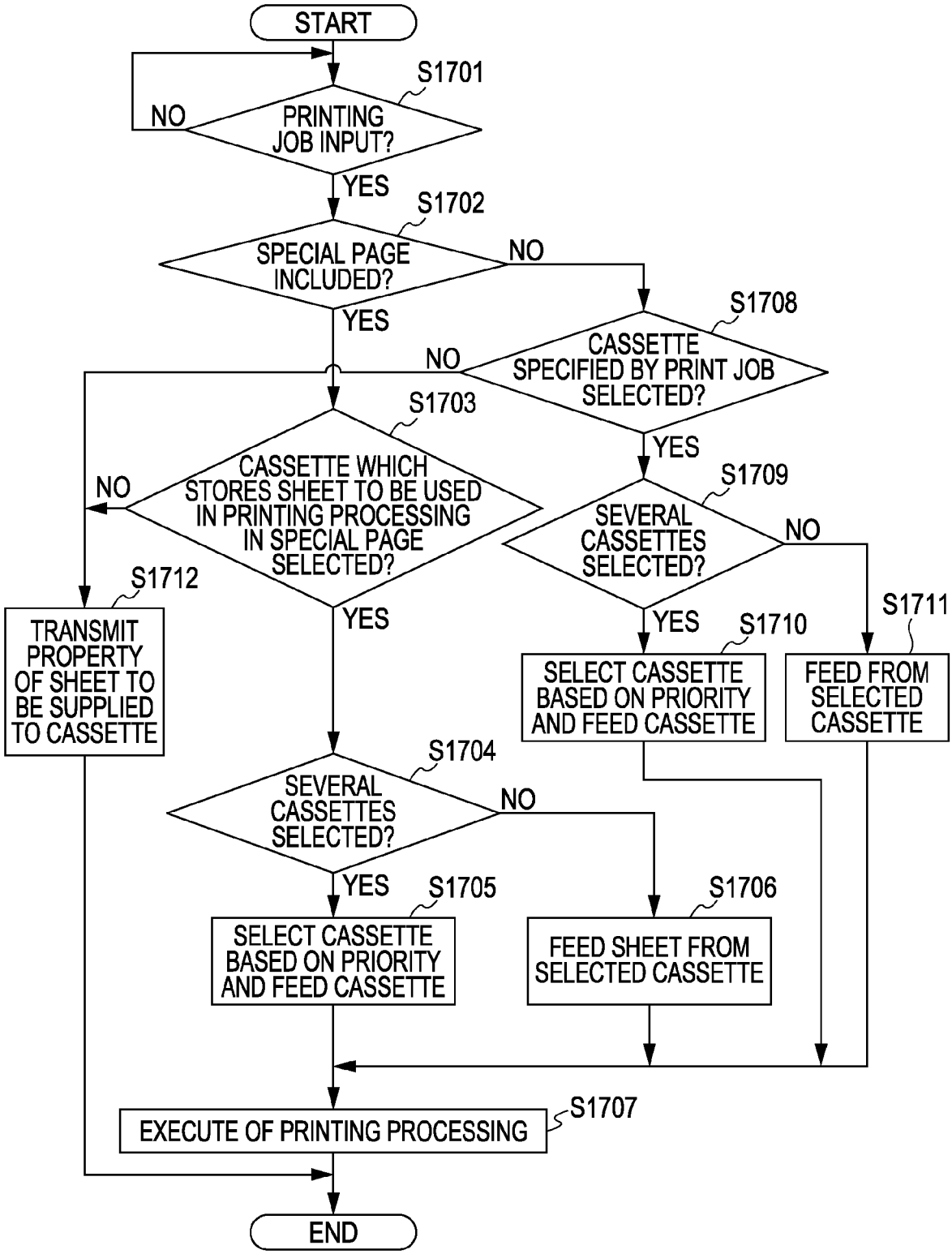
FIG. 17 is a flowchart illustrating processing executed using a CPU included in the printing apparatus.

FIG. 17 is a flowchart illustrating processing executed using the CPU 205 included in the printing apparatus 105.

In step S1701, the CPU 205 determines whether a print job was input. When the determination is affirmative in step S1701, the process proceeds to step S1702. Note that the print job may be received from the computer terminal 233 or may be input by pressing one of the buttons 1501 and 1502 shown in FIG. 15 by the user. In a case where the print job is received from the computer terminal 233, the print job includes image data generated in the computer terminal 233. On the other hand, in a case where the print job is input by operating the operation unit 204 of the printing apparatus 105, the print job includes image data stored in the hard disk 209.

In step S1702, the CPU 205 determines whether the print job includes a special page. When the determination is affirmative in step S1702, the process proceeds to step S1703 whereas when the determination is negative in step S1702, the process proceeds to step S1708. In the case where the print job is input by pressing one of the buttons 1501 and 1502 by the user, the CPU 205 proceeds to step S1703.

In step S1703, the CPU 205 determines a cassette on which sheets to be used in the processing of printing a special page are stacked. Specifically, a type of print job of the special page is determined using a table shown in FIG. 18, and in accordance with "Sheet Feeding Tray" information shown in FIG. 19, the sheet feeding cassette is determined. For example, in a case where the special page corresponds to a test page, the CPU 205 determines that the type of the print job is a test page print job with reference to the table shown in FIG. 18. Note that the CPU 205 determines that a grammage (weight per unit area), which is a paper characteristic, in a range from 64 $g/m^2$ to 209 $g/m^2$ is a range of a characteristic value for the test page print job as shown in FIG. 18. Sheets which have a characteristic value within the range from 64 $g/m^2$ to 209 $g/m^2$ can be suitably used for the test page print job. Note that information on the range of a characteristic value is stored in the hard disk 209. Then, the CPU 205 refers to "Sheet Feeding Tray" information shown in FIG. 19. The table of FIG. 19 is similar to the table of FIG. 14. However, the table of FIG. 19 is different from the table of FIG. 14 in that information on sheet characteristic values is included. Note that, as with the table of FIG. 18, the information on sheet characteristic values of FIG. 19 representing characteristic values of sheets stacked on the cassettes are stored in the hard disk 209. That is, the hard disk 209 functions as a first storage unit which stores information on a range of a characteristic value and functions as a second storage unit which stores information on a characteristic value. The CPU 205 selects a sheet feeding tray on which sheets having a characteristic value within a range from 64 $g/m^2$ to 209 $g/m^2$ which is suitable for the test print job are stacked. In the example shown in FIG. 19, the cassettes 311, 312, and 313, and the manual feeding tray (cassette) 315 are selected. Note that when the CPU 205 does not select any of the sheet feeding cassettes, the process proceeds to step S1712.

In step S1704, the CPU 205 determines whether a plurality of cassettes are selected in step S1703. When it is determined that the CPU 205 selected a plurality of cassettes, the process proceeds to step S1705, whereas when it is determined that the CPU 205 selected only one cassette, the process proceeds to step S1706.

In step S1705, the CPU 205 selects a cassette, from among the plurality of cassettes selected in step S1703, which is to be used in printing processing so that a sheet is supplied from the selected cassette. The selection of the cassette in step S1705 is performed in order of priority which is determined in advance. For example, the priority may be set in the following order: the cassette 311, the cassette 312, the cassette 313, the cassette 314, and the manual feeding tray 315. In step S1706, the CPU 205 supplies a sheet from the sheet feeding cassette selected in step S1703.

In step S1707, the CPU 205 instructs the printer unit 203 to execute printing processing in accordance with the print job input in step S1701. Note that, for the test page print job, the sheet discharging tray 106 is specified as a destination of discharging of the sheet subjected to the printing processing as shown in the table of FIG. 18. Accordingly, the CPU 205 controls the various units included in the binding system 2000 so that the sheet on which the test page has been printed is discharged to the sheet discharging tray 106. Note that discharging destination information representing a destination of discharging of a sheet for the test page print job or the calibration measurement page print job is stored in the hard disk 209. That is, the hard disk 209 functions as a third storage unit which stores the discharging destination information in addition to the information on a range of a characteristic value and the information on a characteristic value.

On the other hand, when the determination is negative in step S1702, the process proceeds to step S1708 where the CPU 205 selects a cassette specified by the print job. A print job which does not include a special page normally includes information used to specify one of the sheet feeding cassettes of the printing apparatus 105. For example, when the print job includes information which specifies the cassette 311, the CPU 205 selects the cassette 311.

In step S1709, the CPU 205 determines whether a plurality of cassettes are selected in step S1708. When the determination is affirmative in step S1709, the process proceeds to step S1710 whereas when the determination if negative in step S1709, the process proceeds to step S1711. For example, when the print job includes only information which specifies "Surface Nature" of the sheet of "high quality", the CPU 205 specifies the cassettes 311, 312, and 313 and the manual feeding tray 315 with reference to the table of FIG. 19.

In step S1710, the CPU 205 selects a cassette, from among the plurality of cassettes selected in step S1708, which is to be used in printing processing so that a sheet is supplied from the selected cassette. The selection of the cassette in step S1710 is performed in order of priority which is determined in advance. For example, the priority may be set in the following order: the cassette 311, the cassette 312, the cassette 313, the cassette 314, and the manual feeding tray 315. In step S1711, the CPU 205 supplies a sheet from the sheet feeding cassette selected in step S1708.

Note that when the determination is negative in step S1703 or in step S1708, the process proceeds to step S1712 where the CPU 205 instructs the operation unit 204 to display a notification representing that sheets suitable for the printing processing performed in accordance with the print job should be supplied to a sheet feeding tray in the screen.

For example, when the print job including the test page is input, the CPU 205 displays a screen shown in FIG. 20 in step S1712.

Note that when one of the cassettes is selected in order of priority in step S1705 or step S1710, it may be checked whether the cassette selected in order of priority is available for the printing processing using the display screen of the operation unit 204 included in the printing apparatus 105. For example, the cassette 314 which has a priority lower than those of the cassettes 311, 312, and 313 is selected, a screen shown in FIG. 21, for example, is displayed in the operation unit 204. When the test page is to be printed, the cassette 314 on which coated sheets are stacked may be happened to be selected. In this case, by displaying the screen of FIG. 21, notification as to whether an expensive coated sheet is to be used for test page print job is displayed for the user as a confirmation. When the user using the printing apparatus 105 presses a button 2001, the CPU 205 allows used of the sheets stacked on the cassette 314 for the print job. On the other hand, when the user using the printing apparatus 105 presses a button 2002, the CPU 205 does not allow the use of the sheets stacked on the cassette 314 for the print job, and the print job is cancelled.

As described above, according to this exemplary embodiment, when printing processing is to be performed in accordance with a special print job (for example, the test page print job), sheets having characteristic values within a range of characteristic values for sheets suitably used for the printing processing can be used in the printing processing.

In the foregoing exemplary embodiment, the sheets used when the printing processing is performed in accordance with the print job including the special page are specified with reference to the table of FIG. 19. In this case, a range of grammage is set as a characteristic value of sheets in the table of FIG. 17, and sheet feeding trays on which sheets having characteristic values within the set range are selected as cassettes used for the printing processing. Note that instead of the determination as to whether sheets stacked on each of the trays have characteristic values within the range of the characteristic values, determination as to whether sheets has characteristics suitable for the print job including the special page may be performed. For example, characteristic values of sheets which can be used in the printing processing performed in accordance with the print job including the special page are specified before the execution of the printing processing, and a sheet feeding tray on which sheets having the specified values are stacked may be used in the printing processing. In this case, even when the sheets do not have the specified values, if the sheets have characteristic values within a predetermined range, a sheet feeding tray on which the sheets having the characteristic values within the predetermined range may be selected.

Furthermore, instead of the grammage, the fixing temperature, the printing speed, or the transfer voltage may be used as the characteristic value. For example, a range of the fixing temperature is determined to be a range from 180° C. to 190° C., and may be added to the table of FIG. 18.

Note that the present invention is also realized by supplying a storage medium including a program code of software which realizes functions of the foregoing exemplary embodiment to the system or the apparatus. In this case, the functions of the foregoing exemplary embodiment are realized by reading and executing the program code stored in the storage medium by a computer included in the system or the apparatus. Furthermore, in this case, the program code read from the storage medium realizes the functions of the foregoing exemplary embodiment, and the storage medium which stores the program code is included in the present invention.

As many apparently widely different exemplary embodiments of the present invention can be made without departing from the spirit and scope thereof, it is to be understood that the invention is not limited to the specific exemplary embodiments thereof except as defined in the appended claims.

This application claims the benefit of Japanese Patent Application No. 2007-328733 filed Dec. 20, 2007, which is hereby incorporated by reference herein in its entirety.

What is claimed is:

1. A printing apparatus comprising:

a plurality of sheet stacking units including at least a first sheet stacking unit and a second sheet stacking unit;

an input unit configured to input a print job to which first characteristic value information representing a range of characteristic values of a sheet to be used for the print job is set;

a storage unit configured to store, for at least the first sheet stacking unit and the second sheet stacking unit, second characteristic value information representing a characteristic value of a sheet stacked in a sheet stacking unit;

a selection unit configured to select, when the print job is inputted, a sheet stacking unit having stacked a sheet within the range of the characteristic values represented by the first characteristic value information, from among the plurality of sheet stacking units, based on the second characteristic value information stored in the storage unit;

a feeding unit configured to feed the sheet form the sheet stacking unit selected by the selection unit; and a printing unit configured to perform print processing of the print job using the sheet fed by the feeding unit, wherein the feeding unit does not feed a sheet in a case where there is no sheet stacking unit having stacked a sheet within the range of the characteristic values represented by the first characteristic value information, among the plurality of sheet stacking units.

2. The printing apparatus according to claim 1, wherein the characteristic value of the sheets represents a weight per unit area of one of the sheets.

3. The printing apparatus according to claim 1, further comprising a display unit configured to display the first characteristic value information, when the selection unit does not select the sheet stacking unit having stacked the sheet within the range of the characteristic values represented by the first characteristic value information.

4. A non-transitory computer-readable medium having stored thereon a computer program comprising program code having computer-executable instructions for causing a computer to execute the control method of claim 1.

5. The printing apparatus according to claim 1, wherein the print job is a calibration job.

6. The printing apparatus according to claim 1, wherein the print job is a test page printing job.

7. The printing apparatus according to claim 1, wherein the selection unit selects a sheet stacking unit based on a predetermined priority order, in a case where there is more than one sheet stacking unit having stacked a sheet within the range of the characteristic values represented by the first characteristic value information.

8. A control method for controlling a printing apparatus, comprising:

inputting a print job to which first characteristic value information representing a range of characteristic values of a sheet to be used for the print job is set;

storing, for at least a first sheet stacking unit and a second sheet stacking unit of a plurality of sheet stacking units, second characteristic value information representing a characteristic value of a sheet stacked in a sheet stacking unit;

selecting, when the print job is inputted, a sheet stacking unit having stacked a sheet within the range of the characteristic values represented by the first characteristic value information, from among the plurality of sheet stacking units, based on the second characteristic value information stored by the storing;

feeding the sheet from the sheet stacking unit selected by the selecting; and printing the print processing of the print job using the sheet fed by the feeding, wherein the feeding does not feed a sheet in a case where there is no sheet stacking unit having stacked a sheet within the range of the characteristic values represented by the first characteristic value information, among the plurality of sheet stacking units.

9. The control method according to claim 8, further comprising displaying the first characteristic value information, when the selecting does not select the sheet stacking unit having stacked the sheet within the range of the characteristic values represented by the first characteristic value information.

10. The control method according to claim 8, wherein the characteristic value of the sheets represents a weight per unit area of one of the sheets.

* * * * *